US005485972A

United States Patent [19]

Mummery et al.

[11] Patent Number: 5,485,972

[45] Date of Patent: Jan. 23, 1996

[54] CABLE RECOVERY WINDER

[75] Inventors: Herbert L. Mummery, deceased, late of Kaneohe, by Lois A. Mummery, executor; Anthony H. Koyamatsu, Kaneohe; Michael B. Young, Mililani, all of Hi.

[73] Assignee: The United States of America as represented by the Secretary of the Navy, Washington, D.C.

[21] Appl. No.: 155,057

[22] Filed: Nov. 19, 1993

[51] Int. Cl.[6] ..... B65H 75/38

[52] U.S. Cl. ..... 242/386; 242/158 R

[58] Field of Search ..... 242/386, 158 R; 57/74, 67, 68, 70, 71

[56] References Cited

U.S. PATENT DOCUMENTS

| | | | |
|---|---|---|---|
| 3,070,324 | 12/1962 | Bryman . | |
| 3,240,438 | 3/1966 | Baselice . | |
| 3,520,492 | 7/1970 | Brown . | |
| 3,677,483 | 7/1972 | Henrich . | |
| 3,848,405 | 11/1974 | Karlson . | |
| 3,977,258 | 8/1976 | Bauer | 242/158 R |
| 4,050,641 | 9/1977 | Henrich | 57/71 |
| 4,087,060 | 5/1978 | Laky et al. . | |
| 4,148,445 | 4/1979 | Reynolds et al. . | |
| 4,164,331 | 8/1979 | Henrich | 57/71 |
| 4,236,373 | 12/1980 | Bravin . | |
| 4,370,849 | 2/1983 | Suzuki | 57/67 |
| 4,411,396 | 10/1983 | Kytir . | |
| 4,597,255 | 7/1986 | Hunter et al. . | |
| 4,623,100 | 11/1986 | Tremblay . | |

FOREIGN PATENT DOCUMENTS

| | | |
|---|---|---|
| 0026763 | 2/1983 | Japan . |
| 0028900 | 1/1990 | Japan . |

*Primary Examiner*—Daniel P. Stodola
*Assistant Examiner*—William A. Rivera
*Attorney, Agent, or Firm*—Harvey Fendelman; Thomas Glenn Keough; Eric James Whitesell

[57] ABSTRACT

An apparatus for producing a wound cable pack having uniform pitch and incorporating a twist per turn in a cable. A drum is constrained to rotational movement around an axis of rotation. A non-rotating spool, sized to fit within the drum and having a central longitudinal axis coaxial with the drum's axis of rotation, is constrained to linear movement along the axis of rotation within the drum. A cable feeding assembly is mounted to the drum for rotation therewith. The cable feeding assembly leads the cable over one end of the spool prior to being fed onto the spool from a feed point. In this way, a twist is induced in the cable as the cable feeding assembly orbits about the spool. An electromechanical system is operatively connected to the drum and the spool to synchronize the rotational movement of the drum with the linear movement of the spool.

12 Claims, 3 Drawing Sheets

CABLE RECOVERY WINDER

STATEMENT OF GOVERNMENT INTEREST

The invention described herein may be manufactured and used by or for the Government of the United States for governmental purposes without the payment of any royalties thereon or therefor.

FIELD OF THE INVENTION

The present invention relates to the field of cable winding mechanisms, and more particularly to cable recovery winders that recover a paid out cable and incorporates a twist per turn as the cable is wound around a non-rotating spool with a uniform pitch.

BACKGROUND OF THE INVENTION

Land-based cable (e.g., fiber optic cable) payout systems are typically mounted on and delivered from a vehicle. In one type of payout system, a spool rotates about its axis while a cable is pulled from it in a direction perpendicular to the spool's axis. In this configuration, an active control system is required to regulate the spool's speed of rotation with respect to the payout vehicle's speed to avoid cable "backlash" or "birdnest".

In an alternative payout system, the spool remains stationary while the cable is pulled from it in a direction parallel to the spool's axis. This configuration is advantageous because the payout system may be passive in that no moving parts or control systems are required. However, during payout from the stationary spool configuration, longitudinal twists occur in the cable at the rate of one twist for each turn of cable payout. If a cable is used several times in this manner without removing the induced twists, it will eventually kink and fail. To avoid accumulating twists, cable may be twisted during winding (called "pre-twisting") in the opposite direction but at the same rate as that induced during the payout. The net result is a neutral or zero twist cable after payout is complete.

One such prior art device designed to produce a pre-twisted center pull roving package is disclosed in U.S. Pat. No. 3,848,405. This device includes a feeding eye that reciprocates transversely with respect to a non-rotating mandrel while it simultaneously rotates about the mandrel. However, by combining the reciprocating action with the rotational action at the point of feeding, the rotating hardware is complex since it must simultaneously control the feeding eye in transversal as well as rotational motion.

Thus, a need exists for a simple cable recovery winder capable of recovering and simultaneously winding the cable. Accordingly, it is an object of the present invention to provide a simple cable recovery winder that recovers a cable and incorporates a twist per turn as the cable is wound such that the cable is ready for payout from a stationary spool configuration. Another object of the present invention is to provide a cable recovery winder that pre-twists the cable as it is wound in accordance with a uniform pitch. Still another object of the present invention is to provide a cable recovery winder adaptable to a variety of spool and cable sizes and types.

SUMMARY OF THE INVENTION

In accordance with the present invention, an apparatus is provided for producing a wound cable pack having uniform pitch and incorporating a twist per turn in a cable. A guide pole is attached to a frame for guiding the cable therealong. A drum has a hollow shaft attached thereto and extending therefrom along a common axis of rotation. The hollow shaft is mounted to the frame to allow rotation about the axis of rotation while the drum is constrained to rotational movement around the axis of rotation. A non-rotating spool sized to fit within the drum and having a central longitudinal axis coaxial with the axis of rotation, is constrained to linear movement along the axis of rotation within the drum. A cable feeding assembly is mounted to the drum for rotation therewith. A cable routing system guides the cable from the guide pole through the hollow shaft over one end of the spool to the cable feeding element. The cable feeding element leads the cable onto the spool from a feed point and imparts an approximate 90° turn in the cable. In this way, a twist is induced in the cable as the cable feeding assembly orbits about the spool.

Also provided is a linear traversing mechanism mounted to the frame and operatively connected to the spool. The linear traversing mechanism causes the spool's linear motion to reciprocate as the cable reaches either end of the spool so that the cable is wound in layers on the spool. A drive shaft is operatively connected to the linear traversing mechanism and to the hollow shaft of the drum. Rotation of the drive shaft causes the rotational movement of the drum and the linear movement of the spool. A drive mechanism is operatively connected to the drive shaft for rotating the drive shaft.

The advantages of the present invention are numerous. A cable may be recovered and wound in a single operation to include a twist per turn. Rotational and linear movement of components are isolated for simplicity of design but synchronized to achieve a uniform cable pack. Cable tension prior to winding may be maintained constant by incorporating an adjustable tensioning pulley in the cable routing system. By incorporating the use of a of flexible guide pole and a slip clutch on the drive shaft of the linear traversing mechanism, the winder is able to absorb a cable snag without breaking the cable.

DESCRIPTION OF THE PREFERRED EMBODIMENT

Figure 1:
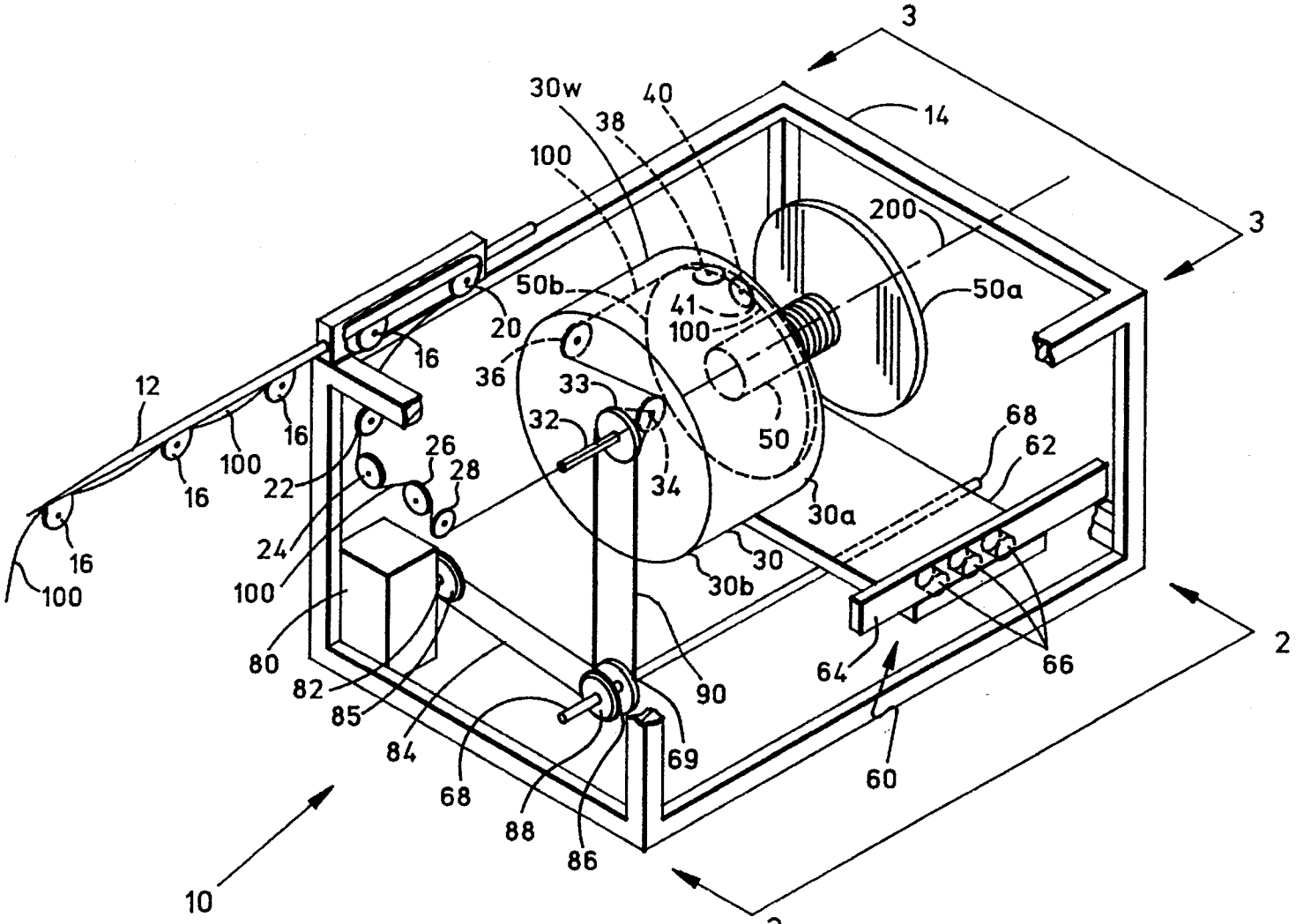
FIG. 1 is a perspective view of the cable recovery winder according to the present invention showing the functional elements and their relationships to one another, depicting the spool at its maximum extent outside the drum.

Referring now to the drawings and more particularly to FIG. 1, a perspective view is shown of the cable recovery winder 10 according to the present invention. It is to be understood that FIG. 1 is provided primarily to describe the functional aspects of the present invention. Accordingly, various structural support elements of the present invention have been omitted from FIG. 1 for sake of clarity. These structural and support elements will be presented and described later below.

In FIG. 1, a cable 100 is picked-up from a deployed position and first led along a recovery guide pole 12. Guide pole 12 extends from and is supported at one end near the top of a rigid frame 14. A plurality of guides or pulleys 16 are attached to guide pole 12 to guide cable 100 therealong. Guide pole 12 is preferably a flexible pole made from such materials as fiberglass or graphite fiber. Flexibility of guide pole 12 provides initial shock absorption for the cable 100 if it snags as it is being recovered.

Once within the confines of frame 14, cable 100 is guided by a succession of pulleys 20, 22, 24, 26 and 28. The quantity and arrangement of pulleys 20–28 are provided as a representative example of how cable 100 may be routed. It will be apparent that other cable routing arrangements may be used without departing from the scope of the present invention. Tension in cable 100 is applied at a constant rate by providing one of the pulleys, such as pulley 26, as an adjustable tensioning pulley. Pulleys 20–28 may also be provided with pulley guards (not shown for purpose of clarity) to keep cable 100 from coming out of each pulley's wheel.

Mounted coaxially within frame 14 are a rotating drum 30 and a non-rotating spool 50, which may have flanges **50*a* and 50*b* as shown. Drum 30 and spool 50 are sized such that spool 50 fits within drum 30. Drum 30 is open on one end 30*a* and is solid, or partially solid, on its other end 30*b*. End 30*b* supports and is fixed to a hollow shaft 32 extending therethrough and therefrom at the central axis represented by dotted line 200 of drum 30. Hollow shaft 32 is mounted within frame 14 such that both it and drum 30 are free to rotate together around axis 200. Positioning of pulley 28 is such that as cable 100 exits pulley 28, cable 100 passes through hollow shaft 32 into the confines of drum 30**.

Within drum 30, a succession of pulleys 34, 36, 38 and 40 are provided to guide cable 100 along sidewall **30*w* of drum 30 over one end (e.g., flange 50*b*) of spool 50 as shown to a feed point 41 that is positioned to place cable 100 on spool 50. Pulleys 34, 36, 38 and 40 may also be provided with pulley guards (not shown for purpose of clarity) to keep cable 100 from coming out of each pulley's wheel. The quantity and specific arrangement of pulleys 34, 36, 38 and 40 are provided as a representative example of how cable 100 may be routed to feed point 41 and then onto spool 50. However, it is to be understood that other cable routing guides and arrangements therefor may be employed. It is preferable that cable 100 is fed over one end of spool 50 and turned 90° at feed point 41 so that cable 100 is placed on spool 50 so as to introduce a twist in the cable as feedpoint 41 orbits spool 50**.

Spool 50 is mounted to a traversing mechanism 60 such that spool 50 is coaxial with drum 30 along axis 200. Traversing mechanism 60 is a linear motion assembly used to move spool 50 back and forth within drum 30. Traversing mechanism 60 would typically include a traversing table 62 with spool mounting supports (not shown in FIG. 1) and table guide and support rails 64 on either side of table 62 (only one rail 64 is shown in FIG. 1). Table 62 moves linearly along rails 64 by means of guide bearings 66. Linear movement of traversing mechanism 60 is provided by a rotatable shaft 68 having a linear friction bearing (not shown in FIG. 1) synchronized to move a selected linear distance for each rotation of shaft 68 to achieve a desired amount of cable pitch. The linear friction bearings 67 are coupled to spool 50 via coupling blocks 71, table 62 and its spool mounting supports 61 a shown in FIGS. 2 and 3.

Rotational movement of drum 30 and linear movement of spool 50 are synchronized to one another in the following manner. A drive mechanism such as an electric or gasoline motor 80 is typically supported within frame 14. Output shaft 82 of motor 80, is coupled to rotatable shaft 68 by a drive belt 84 passed over drive pulleys 85 and 86 respectively mounted on output shaft 82 and rotatable shaft 68. Drive pulley 86 may also be provided with an adjustable slip clutch 88 for absorbing start-up shock and to cushion the winding operation from sharp increases in cable tension caused by snags. Rotatable shaft 68 and hollow shaft 32 are each provided with aligned sprockets 69 and 33, respectively. A drive chain 90 drivably connects sprockets 69 and 33.

In operation, cable 100 is first threaded along guide pole 12, through the above-described cable routing system, past feed point 41, and onto spool 50. When the cable recovery/winding operation is to begin, motor 80 is activated and shaft 68 begins to turn via drive belt 84. Rotation of shaft 68 generates the rotational movement of drum 30 and the linear motion of spool 50 with respect to drum 30 as described above. As drum 30 rotates and lays cable 100 onto spool 50, a pre-twist of cable 100 is induced at the rate of a twist per turn (i.e., one twist per one rotation of drum 30 about spool 50). This is due to routing cable 100 over one end of spool 50 prior to being wound onto spool 50. The direction of rotation of drum 30 is such that cable is pre-twisted in a direction opposite to what will be induced in cable 100 during payout.

Figure 2:
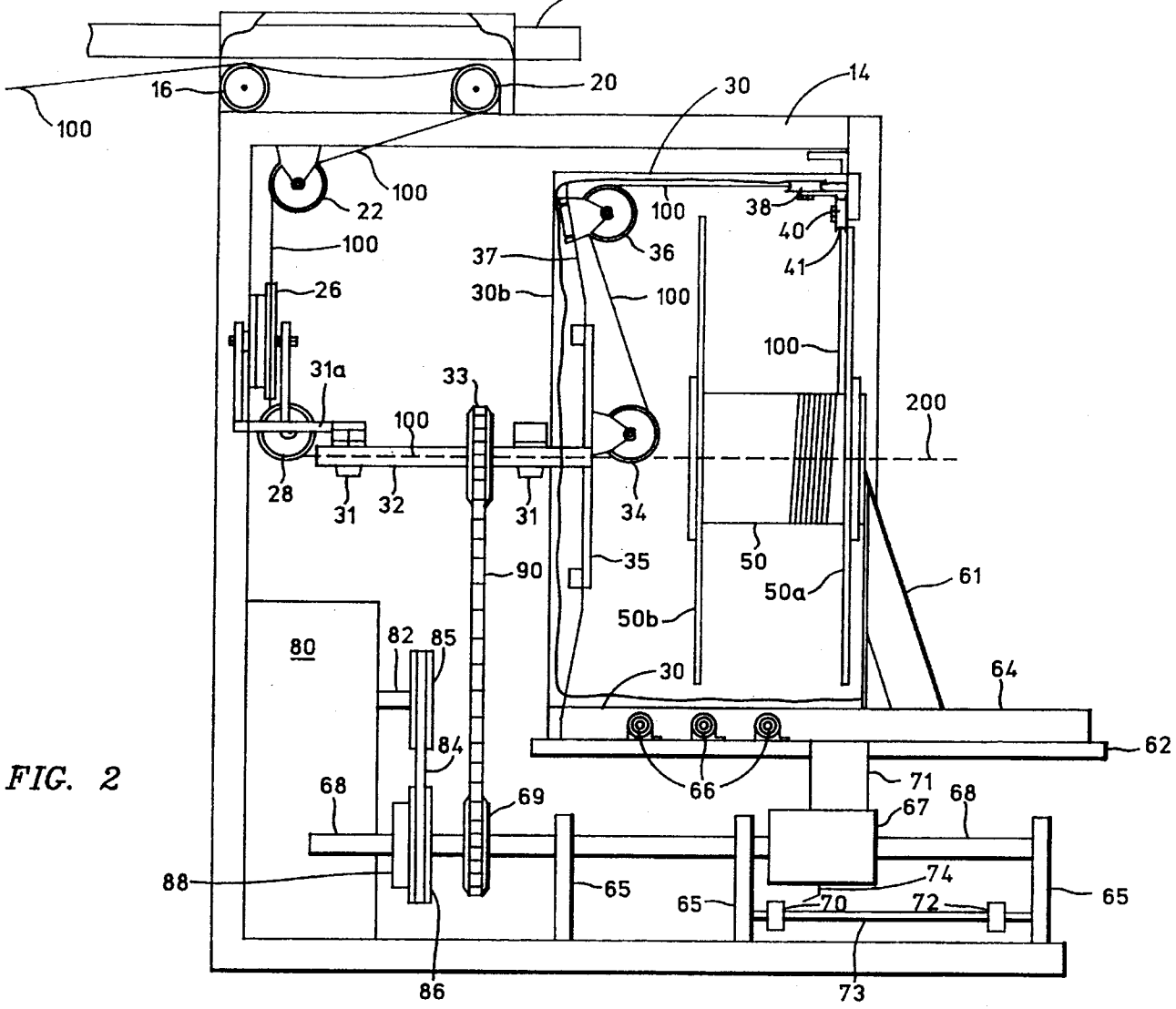
FIG. 2 is a side view generally along line 2—2 of FIG. 1 showing the functional elements as well as the structural elements for supporting same in accordance with the present invention, with the exception that the spool is depicted at its maximum extent within the drum.
Figure 3:
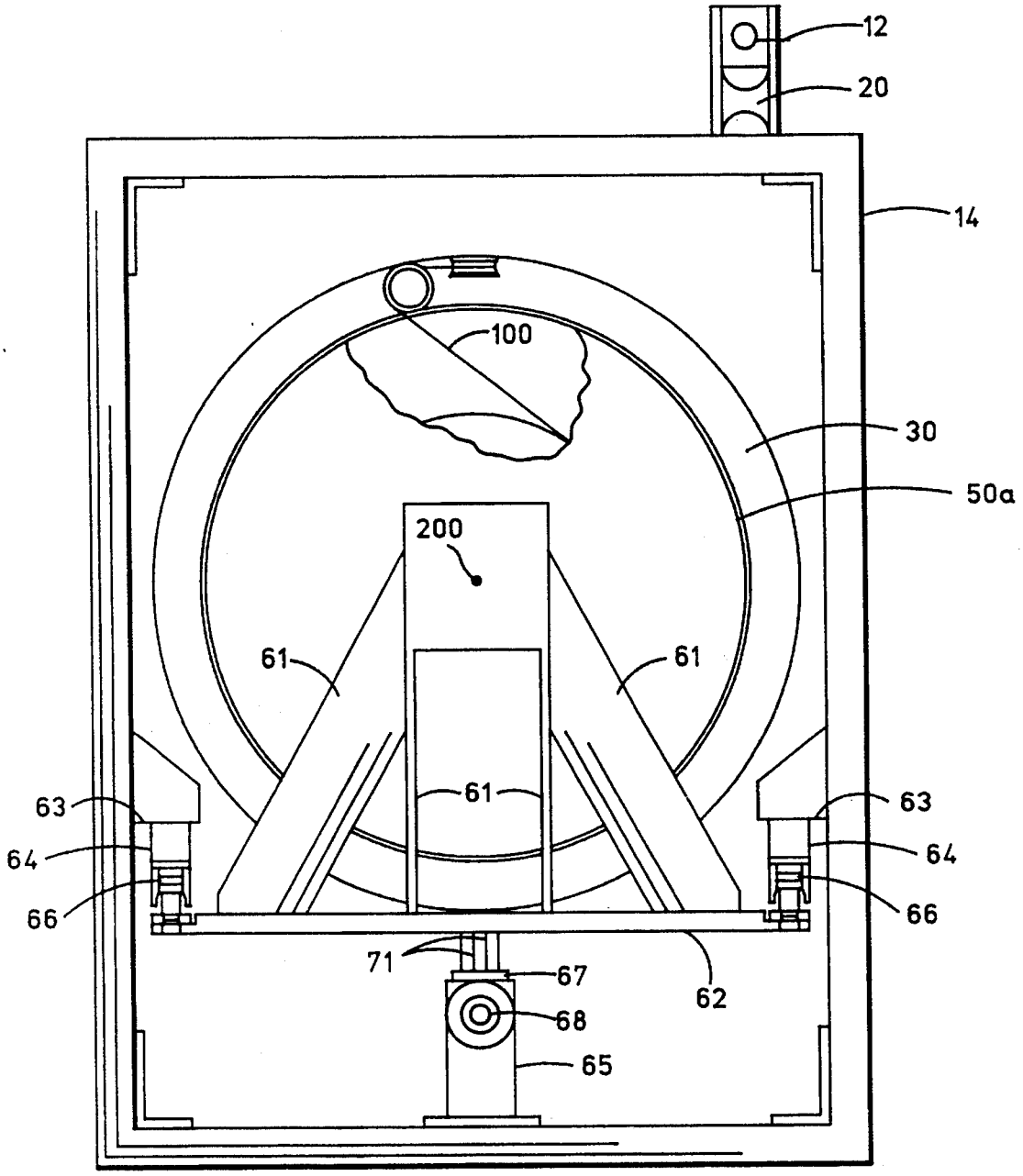
FIG. 3 is a back view along line 3—3 of FIG. 1 showing additional structural elements for supporting the functional elements in accordance with the present invention.

The various structural and support elements omitted from FIG. 1 for clarity will now be addressed by way of non-limiting example in FIGS. 2 and 3 where like reference numerals have been used for the elements common with FIG. 1. In FIG. 2, a side view along line 2—2 of FIG. 1 is shown to depict pulleys 20, 22, 24, 26 and 28 mounted to frame 14; hollow shaft 32 rotatingly mounted by bearings 31 that are supported from frame 14 by support arm 31a; pulley 34 supported on a mounting plate 35 fixed to hollow shaft 32; pulley 36 mounted on a bracket 37 connecting plate 35 to drum 30; pulleys 38 and 40 mounted on drum 30; and spool mounting supports 61 mounted on traversing table 62 for supporting spool 50. FIG. 3 is a back view of cable recovery winder 10 along lines 3—3 of FIG. 1 showing more clearly the relationship between mounting supports 61, traversing table 62, guide rails 64 mounted onto frame 14 with brackets 63, and guide bearings 66. Also shown is shaft 68 mounted within bearing housing 65 and the linear friction bearing 67 used to impart the linear motion of traversing mechanism 60. Flange **50*a* is further depicted in a partial cutaway view to show cable 100 as it is wound onto spool 50**.

Referring now to FIG. 2, travel of cable 100 from end-to-end (e.g., flange-to-flange) of spool 50 is accomplished by linearly moving spool 50 back and forth along axis 200 while cable feed point 41 is fixed to drum 30. In this way, the components that rotate about spool 50 may be simple guide pulleys and not complex feeding and traversing mechanisms. Since shaft 68 continues to rotate in the same direction and rate regardless of the direction of linear motion of spool 50, drum 30 continually rotates feed point 41 thereby laying cable 100 uniformly and consistently without overlap at each end of spool 50. Adjustments may be made as to the amount of linear travel of spool 50 per rotation of shaft 68 to thereby adjust the winding pitch of cable 100.

The physical limits of the spool's traverse in either direction along axis 200 are set by a pair of stop blocks 70 and 72 mounted on stationary bar 73 that is parallel to rotatable shaft 68. Stop blocks 70 and 72 are spaced apart along the length of shaft 73. Positioning of stop blocks 70 and 72 is adjustable to accommodate a variety of spool lengths. Note that the limit to any spool's length is essentially the depth of drum 30.

As contact, actuating lever 74 of linear friction bearing 67 contacts one of blocks 70 or 72, the direction of motion of linear friction bearing 67 reverses itself as rotatable shaft 68 continues to rotate in the same direction. Such reciprocating, linear motion traversing mechanisms are well known in the art. Accordingly, the particular choice of such mechanism is not a limitation of the present invention. By way of example, one such linear traversing mechanism embodying the structure and features described above is model number 3RG 20MCRF manufactured by Amacoil Inc.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An apparatus for producing a wound cable pack having a uniform pitch and incorporating a twist per turn in a cable, comprising:

a drum having an axis of rotation, said dram being constrained to rotational movement around said axis of rotation;

a non-rotating spool sized to fit within said drum and having a central longitudinal axis coaxial with said drum's axis of rotation, said spool being constrained to linear movement along said axis of rotation within said drum;

a cable feeding assembly mounted to said drum for rotation therewith, said cable feeding assembly leading said cable onto said spool from a feed point such that a twist is induced in said cable as said cable feeding assembly orbits about said spool;

a drive mechanism operatively connected to said drum and said spool for rotating said drum and, in synchronism therewith, for imparting said linear movement to said spool, wherein said twist per turn is induced in said cable for each rotation of said drum, and wherein said uniform pitch is determined by the amount of said linear movement for each rotation of said drum; said drive mechanism comprising:

a linear traversing mechanism operatively connected to said spool;

a drive shaft operatively connected to said linear traversing mechanism and to said drum, wherein rotation of said drive shaft causes said rotational movement of said drum and said linear movement of said spool; and a motor operatively connected to said drive shaft for rotating said drive shaft.

2. An apparatus as in claim 1 wherein said motor is operatively connected to said drive shaft with an adjustable slip clutch.

3. An apparatus as in claim 1 wherein said linear traversing mechanism includes means for causing said spool to reciprocate as said cable reaches either end of said spool, wherein said cable is wound in layers on said spool.

4. An apparatus for producing a wound cable pack having uniform pitch and incorporating a twist per turn in a cable, comprising:

a frame;

a drum having a hollow shaft attached thereto and extending therefrom along a common axis of rotation, said hollow shaft being mounted to said frame to allow rotation about said axis of rotation, wherein said drum is constrained to rotational movement around said axis of rotation;

a non-rotating spool sized to fit within said drum and having a central longitudinal axis coaxial with said axis of rotation, said spool being constrained to linear movement along said axis of rotation within said drum;

a cable feeding assembly mourned to said drum for rotation therewith;

cable routing means for guiding said cable from a pick-up point outside said frame through said hollow shaft to said cable feeding assembly;

said cable feeding assembly leading said cable over an end of said spool onto said spool from a feed point, said cable feeding assembly imparting an approximate 90° turn in said cable at said feed point such that a twist is induced in said cable as said cable feeding assembly orbits about said spool;

a linear traversing mechanism mounted to said frame and operatively connected to said spool;

a drive shaft operatively connected to said linear traversing mechanism and to said hollow shaft, wherein rotation of said drive shaft causes said rotational movement of said dram and, in synchronism therewith, imparts said linear movement to said spool via said linear traversing mechanism; and a motor operatively connected to said drive shaft for rotating said drive shaft.

5. An apparatus as in claim 4 wherein said cable routing means further includes an adjustable tensioning pulley operatively communicating with said cable between said pick-up point and said hollow shaft, wherein a constant tension is maintained between said tensioning pulley and said spool.

6. An apparatus as in claim 4 wherein said motor is operatively connected to said drive shaft with an adjustable slip clutch.

7. An apparatus as in claim 4 wherein said linear traversing mechanism includes means for causing said spool to reciprocate as said cable reaches either end of said spool, wherein said cable is wound in layers on said spool.

8. An apparatus for producing a wound cable pack having uniform pitch and incorporating a twist per turn in a cable, comprising:

a frame;

a guide pole attached to said frame for guiding said cable therealong;

a drum having a hollow shaft attached thereto and extending therefrom along a common axis of rotation, said hollow shaft being mounted to said frame to allow rotation about said axis of rotation, wherein said drum is constrained to rotational movement around said axis of rotation;

a non-rotating spool sized to fit within said drum and having a central longitudinal axis coaxial with said axis of rotation, said spool being constrained to linear movement along said axis of rotation within said drum;

a cable feeding assembly mounted to said drum for rotation therewith;

cable routing memos for guiding said cable from said guide pole through said hollow shaft to said cable feeding assembly;

said cable feeding assembly leading said cable over an end of said spool onto said spool from a feed point, said cable feeding assembly imparting an approximate 90° turn in said cable at said feed point such that a twist is induced in said cable as said cable feeding assembly orbits about said spool;

a linear traversing mechanism mounted to said frame and operatively connected to said spool, said linear traversing mechanism including means for causing said spool to reciprocate as said cable reaches either end of said spool, wherein said cable is wound in layers on said spool;

a drive shaft operatively connected to said linear traversing mechanism and to said hollow shaft of said drum, wherein rotation of said drive shaft causes said rotational movement of said drum and, in synchronism therewith, imparts said linear movement to said spool via said linear traversing mechanism; and a motor operatively connected to said drive shaft for rotating said drive shaft.

9. An apparatus as in claim 8 wherein said guide pole is flexible.

10. An apparatus as in claim 8 wherein said cable routing means further includes an adjustable tensioning pulley operatively communicating with said cable between said guide pole and said hollow shaft, wherein a constant tension is maintained between said tensioning pulley and said spool.

11. An apparatus as in claim 8 wherein said drive shaft includes an adjustable slip clutch mounted thereto in driving communication with said motor via a drive belt.

12. An apparatus as in claim 8 wherein said drive shaft is operatively connected to said hollow shaft by means of a chain and sprocket assembly.

* * * * *